US011918922B2

(12) United States Patent
Pucci et al.

(10) Patent No.: US 11,918,922 B2
(45) Date of Patent: Mar. 5, 2024

(54) GAMING TABLE SYSTEMS AND METHODS FOR USE

(71) Applicant: FlipOut!, Hudson, OH (US)

(72) Inventors: Daniel Pucci, Hudson, OH (US); Anthony Pucci, Hudson, OH (US)

(73) Assignee: FlipOut!, Hudson, OH (US)

( * ) Notice: Subject to any disclaimer, the term of this patent is extended or adjusted under 35 U.S.C. 154(b) by 7 days.

(21) Appl. No.: 17/827,402

(22) Filed: May 27, 2022

(65) Prior Publication Data

US 2023/0381635 A1 Nov. 30, 2023

(51) Int. Cl.
*A63F 7/00* (2006.01)

(52) U.S. Cl.
CPC ..... *A63F 7/0023* (2013.01)

(58) Field of Classification Search
CPC ..... A63F 7/0023; A63F 7/025; A63F 7/027; A63F 2007/0029; A63F 2007/0035; A63F 2007/0041
See application file for complete search history.

(56) References Cited

U.S. PATENT DOCUMENTS 3,653,665 A * 4/1972 Wahlberg ..... A63F 7/0023 273/125 R
5,368,300 A * 11/1994 Becker ..... A63F 7/025 273/119 R
5,704,610 A * 1/1998 Goldfarb ..... A63F 7/0017 273/119 B
5,961,116 A * 10/1999 Beyer ..... A63F 7/027 273/129 R

FOREIGN PATENT DOCUMENTS

DE 202012003634 U1 * 8/2012 ..... A63F 7/0023

* cited by examiner

*Primary Examiner* — Raleigh W Chiu
(74) *Attorney, Agent, or Firm* — Calfee, Halter & Griswold LLP

(57) ABSTRACT

A gaming table includes a playing surface and a rail surrounding the playing surface. The playing surface includes a plateau in the center which may release one or more balls. The balls may roll off the plateau toward one or more input apertures in an inside wall of the rail. Flippers near each goal may be pivoted or actuated to deflect balls from rolling into the respective goal. Balls which pass through one of the goals may be retained in a collection chamber and retrieved by a user through a retrieval aperture in an outside wall of the rail. The playing surface may include ridges to direct released balls toward each of the goals and obstacles to prevent balls from rolling directly into the goals.

19 Claims, 18 Drawing Sheets

GAMING TABLE SYSTEMS AND METHODS FOR USE

BACKGROUND

Gaming tables such as pool or billiards tables, poker tables, foosball tables, pinball tables, ping-pong or table tennis tables, shuffleboard tables, air hockey tables, and rod hockey tables are known in the art and are used as entertainment or amusement devices. However, such gaming tables have been known and played for years and, as a result, the entertainment or amusement value of such tables is diminished as the user experience may be repetitive and become stale. Accordingly, it is appreciated that a need exists for a new gaming table for the entertainment and amusement of users or players.

Additionally, many gaming tables, such as pool or billiards tables, require a large amount of space and do not fit in a residence of a user. For example, pool or billiards tables require space not only for the table itself but also sufficient space around the table such that users may operate pool or billiards cues around the perimeter of the table. Therefore, a need exists for a new gaming table that is sized and shaped to fit in the residence of a user.

Further, some gaming tables, such as pinball tables, are only playable by a single user at a time. Such tables are not configured for multiple users to use the table or play simultaneously. Thus, it is appreciated that a need exists for a new gaming table that can accommodate multiple users simultaneously.

SUMMARY

This summary is meant to provide some examples and is not intended to be limiting of the scope of the invention in any way. For example, any feature included in an example of this summary is not required by the claims, unless the claims explicitly recite the features. Also, the features, components, steps, concepts, etc. described in examples in this summary and elsewhere in this disclosure can be combined in a variety of ways. Various features and steps as described elsewhere in this disclosure can be included in the examples summarized here.

In one embodiment, a gaming table is disclosed. The table has a top surface including a plateau disposed in a center of the top surface and a plurality of table sections disposed around the plateau. The table also includes a rail disposed around the top surface and including an inside wall, a top wall, and an outside wall. The inside wall includes an input aperture disposed adjacent to a center of an outside edge of each table section. The table also includes flippers disposed on opposite sides of the input apertures and a flipper actuation button corresponding to each flipper. The plateau is moveable between a first position lower than a remainder of the top surface and a second position higher than the remainder of the top surface. Activation of each flipper actuation button moves the flipper between a first orientation and a second orientation.

In another embodiment, a gaming table system is disclosed. The gaming table system includes a plurality of balls, an energy source, and a gaming table. The gaming table includes a top surface with a plateau in a center of the top surface and a plurality of table sections disposed around the plateau, a rail disposed around the top surface and including an inside wall, a top wall, and an outside wall, the inside wall including an input aperture disposed adjacent to a center of an outside edge of each table section, and flippers disposed on opposite sides of the input apertures and moveable between a first orientation and a second orientation. The plateau is moveable between a first position lower than a remainder of the top surface and a second position higher than the remainder of the top surface. The energy source is configured to supply energy to move the plateau from the first position to the second position and to move the flippers from the first orientation to the second orientation.

In another embodiment, a method for using a gaming table is disclosed. The method includes placing a plurality of balls on a plateau of a top surface of the gaming table, releasing the plurality of balls from the plateau, allowing the balls to roll from the plateau onto at least two table sections of the gaming table, actuating a flipper between a first orientation and a second orientation, allowing the balls to pass through input apertures corresponding to each table section, and calculating a result.

A further understanding of the nature and advantages of the present invention are set forth in the following description and claims, particularly when considered in conjunction with the accompanying drawings in which like parts bear like reference numerals.

BRIEF DESCRIPTION OF THE DRAWINGS

To further clarify various aspects of implementations of the present disclosure, a more particular description of the certain examples and implementations will be made by reference to various aspects of the appended drawings. These drawings depict only example implementations of the present disclosure and are therefore not to be considered limiting of the scope of the disclosure. Moreover, while the FIGS. can be drawn to scale for some examples, the FIGS. are not necessarily drawn to scale for all examples. Examples and other features and advantages of the present disclosure will be described and explained with additional specificity and detail through the use of the accompanying drawings in which.

DETAILED DESCRIPTION

Figure 1:
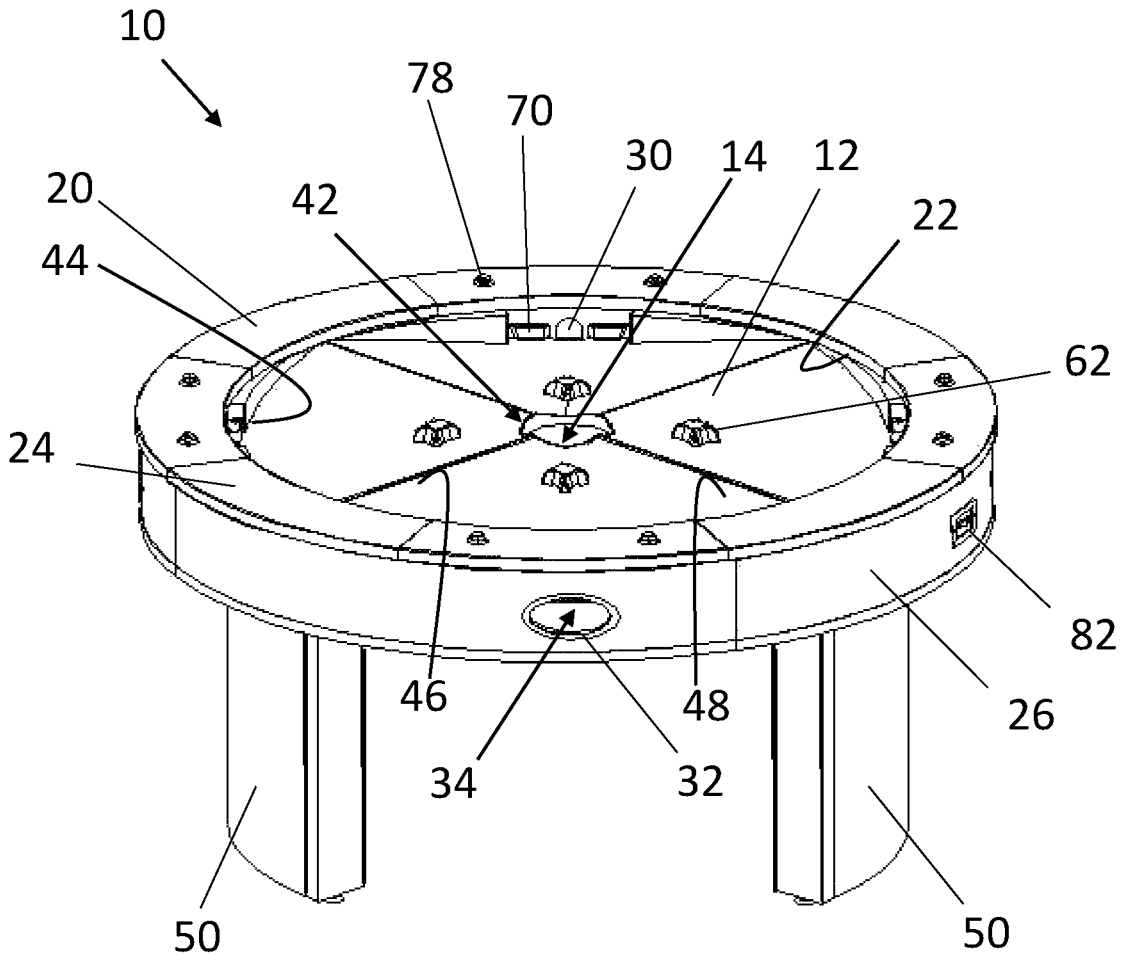
FIG. 1 illustrates a top perspective view of an exemplary gaming table.
Figure 2:
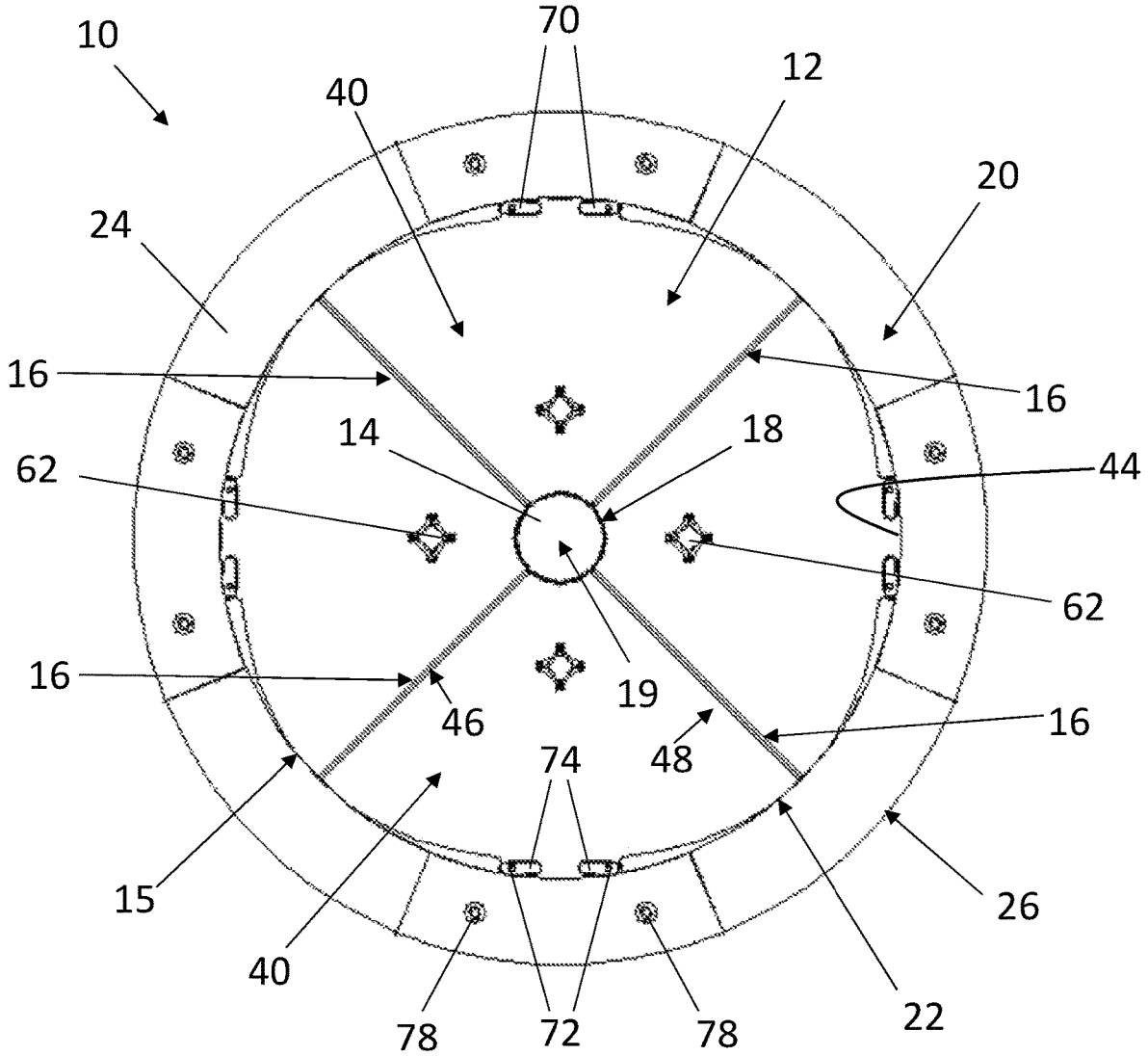
FIG. 2 illustrates a top view of the exemplary gaming table of FIG. 1.

The following description refers to the accompanying drawings, which illustrate example implementations of the present disclosure. Some implementations having different structures and operation do not depart from the scope of the present disclosure.

As described herein, when one or more components are described as being connected, joined, affixed, coupled, attached, or otherwise interconnected, such interconnection can be direct as between the components or can be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

Referring to FIGS. 1-7, a gaming table 10 is depicted according to one embodiment. The table 10 includes a playing or top surface 12, a bottom surface 13 opposite the top surface 12, and a cushion or rail 20 surrounding the top surface 12. The top surface 12 has an edge 15 extending around the outside circumference or perimeter of the top surface 12. In the illustrated embodiment, the top surface 12 is circular. However, as detailed below, the top surface 12 may have any suitable shape or configuration. The rail 20 includes an inside wall 22 abutting and extending substantially perpendicular above the edge 15 of the top surface 12, a top wall 24 disposed above the top surface 12 and extending horizontally outwardly from the inside wall 22, and an outside wall 26 opposite the inside wall 22 and extending substantially perpendicular below the top wall 24 of the rail 20.

The rail 20 includes one or more goals or input apertures 30 extending into the inside wall 22. The table 10 may include a number of input apertures 30 equal to the desired number of players or users for the table 10. In the illustrated embodiment, the rail 20 includes four input apertures 30. However, it will be appreciated that the table 10 may include any number of input apertures 30. For example, the table 10 may include one, two, three, or five or more input apertures 30. In some embodiments, as described below, the rail 20 may be modular or adjustable to accommodate varying numbers of users.

Each input aperture 30 has a height extending vertically from a first location substantially equal to the height of the edge 15 of the top surface 12 adjacent to the input aperture 30 and up to a second location substantially high enough to allow a playing ball to pass between the first and second locations, as described below. Each input aperture 30 also has a width extending horizontally between a first position and second position where the distance between the first and second positions is wide enough to allow a playing ball to pass between the first and second positions. Each input aperture 30 may have a width between about 50 mm and about 100 mm, such as between about 65 mm and about 85 mm, such as about 73 mm, and a height between about 30 mm and about 60 mm, such as between about 35 mm and about 50 mm, such as about 42 mm. In the illustrated embodiment, each input aperture 30 is arch-shaped with a substantially flat bottom edge and a curved top edge. However, it will be appreciated that the input apertures 30 may have any suitable size, shape, or configuration. For example, the input apertures 30 may be rectangular, oval, triangular, or any other suitable shape.

Each input aperture 30 may include one or more devices or counters which may count the number of balls which pass through the input aperture 30. For example, each input aperture 30 may include a light sensor, rotatable counter, gate, or another mechanism capable of detecting and counting the balls which pass through the input aperture 30.

The rail 20 may also include one or more retrieval apertures 32 extending into the outside wall 26 substantially opposite each input aperture 30 and a collection chamber 34 disposed between and connecting each pair of input apertures 30 and retrieval apertures 32. The rail 20 of the table 10 may have a number of retrieval apertures 32 and number of collection chambers 34 equal to the number of input apertures 30. The collection chambers 34 are disposed within the rail 20 and configured to hold or contain a plurality of balls or objects which pass through each input aperture 30 from the top surface 12. The collection chambers 34 may have a bottom surface disposed below the first location of each input aperture 30 (e.g., the height of the edge 15 of the top surface 12 at each input aperture 30) such that a ball which rolls or otherwise enters the collection chamber 34 through the input aperture 30 would not roll or otherwise move back out of the input aperture 30 and onto the top surface 12. The collection chambers 34 may be any suitable size, shape or configuration for containing a plurality of balls or objects. For example, the collection chambers 34 may be substantially box-shaped, cylindrical, spherical, or any other suitable shape.

The retrieval apertures 32 are sized and shaped such that a user may retrieve one or more balls or objects from within the collection chamber 34, such as by hand. The retrieval apertures 32 are sized, shaped, and configured such that a user may reach his or her hand through the retrieval aperture 32 and into the collection chamber 34 to grasp and retrieve one or more balls or objects disposed in the collection chamber 34. The bottom of each retrieval aperture 32 may be disposed above the bottom surface of the respective collection chamber 34 such that balls or objects disposed within the collection chamber 34 do not roll or otherwise move out of the collection chamber 34 through the retrieval aperture 32 without user intervention. In the illustrated embodiment, the retrieval apertures 32 are substantially elliptical. However, it will be appreciated that the retrieval apertures 32 may have any size, shape, or configuration such that a user may retrieve one or more balls or objects from the collection chamber 34. For example, the retrieval apertures 32 may be circular, oval, triangular, rectangular, or any other suitable shape.

Figure 3:
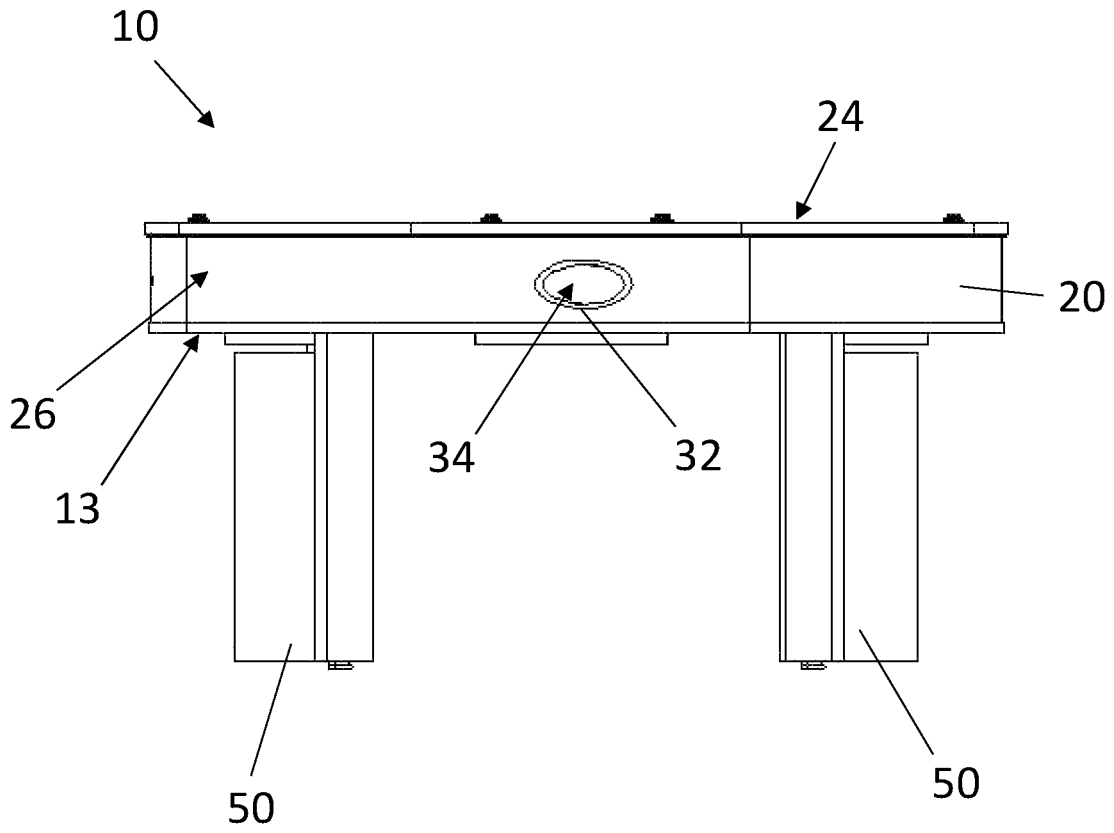
FIG. 3 illustrates a side view of the exemplary gaming table of FIG. 1.
Figure 4:
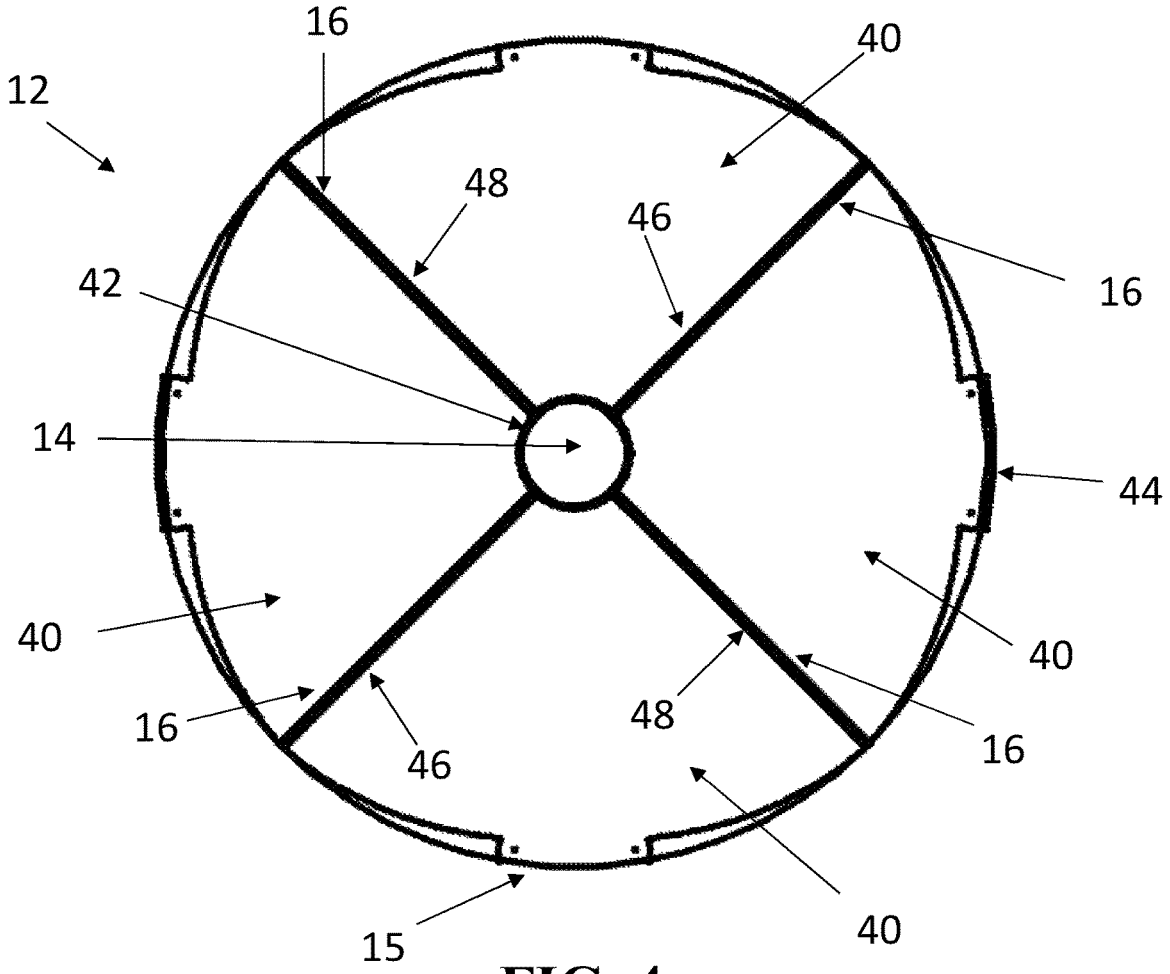
FIG. 4 illustrates a top view of an exemplary top surface of a gaming table.
Figure 5:
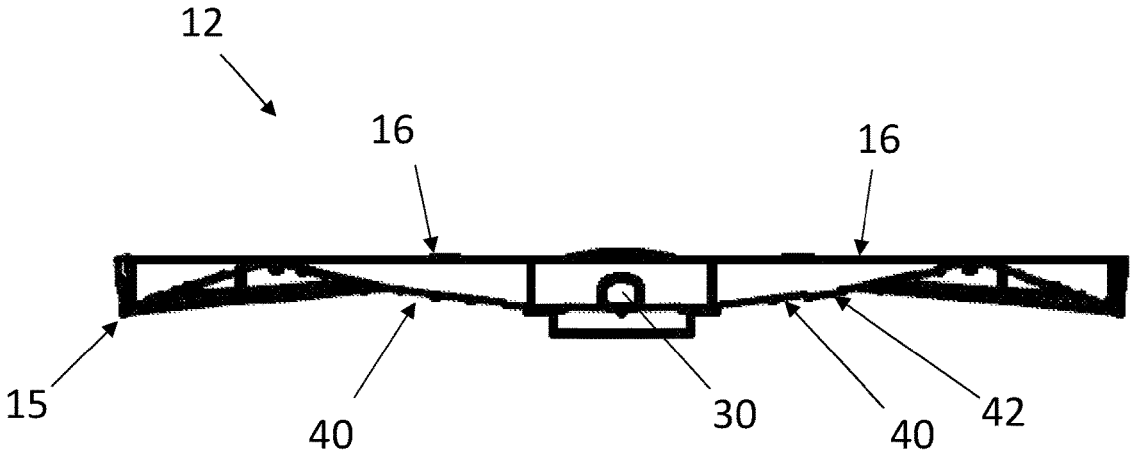
FIG. 5 illustrates a side view of the top surface of FIG. 5.
Figure 6:
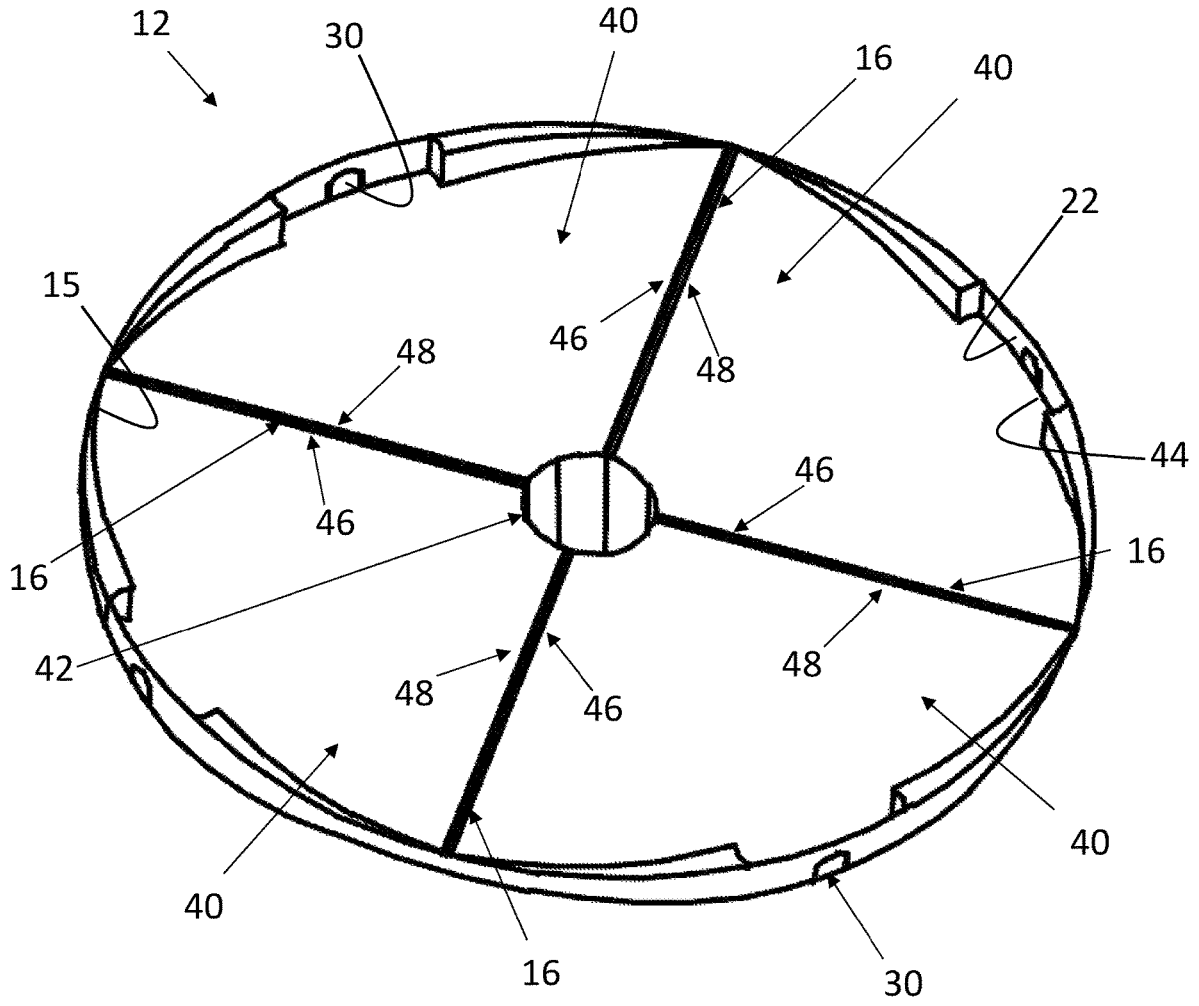
FIG. 6 illustrates a top perspective view of the top surface of FIG. 5 without a plateau.
Figure 7:
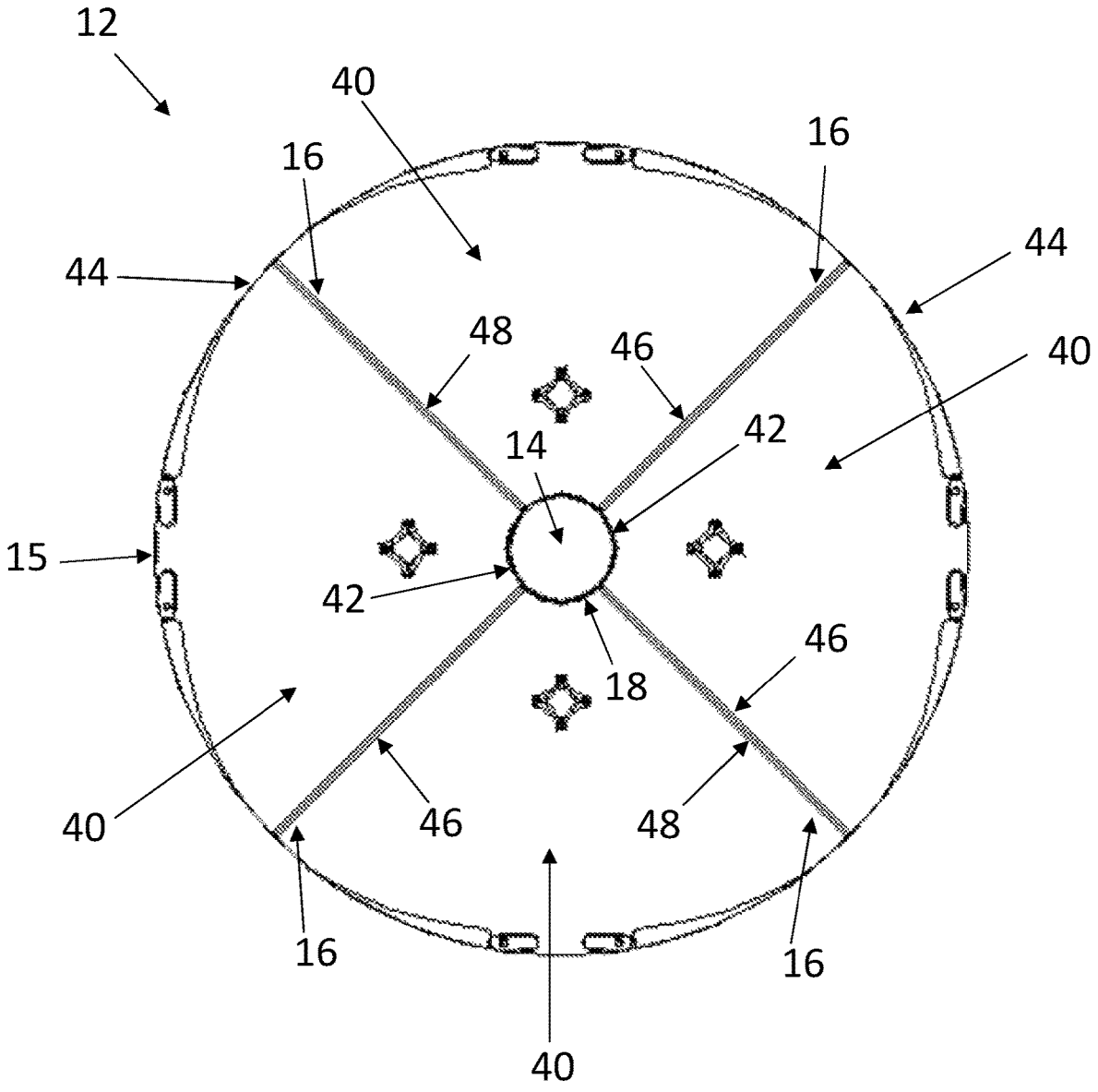
FIG. 7 illustrates a top view of another exemplary top surface of a gaming table.
Figure 8:
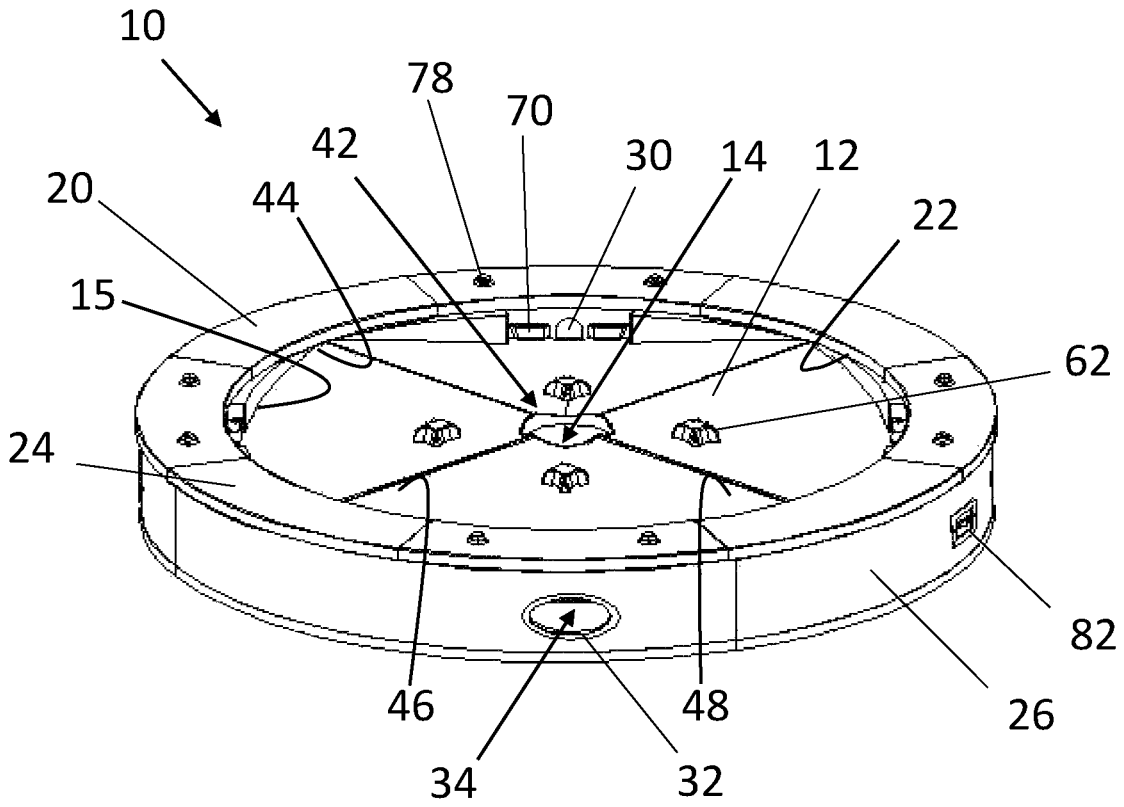
FIG. 8 illustrates a top perspective view of another exemplary gaming table.

In some embodiments, such as shown in FIGS. 1 and 3, the table 10 includes one or more legs 50 disponed beneath and extending below the bottom surface 13. The one or more legs 50 are capable of supporting the table 10 in a standing position on the floor or ground. The legs 50 may extend to a height such that the top surface 12 of the table 10 is at a height substantially equal to the waist or just above the waist of a user. In the illustrated embodiment, the table 10 has four legs 50. However, it will be appreciated that the table 10 may have any suitable number and configuration of legs 50. For example, the table 10 may have one leg 50 disposed substantially in the middle of the table 10, two legs 50 disposed on substantially opposite sides of the table 10, three legs 50 disposed substantially equally around the table 10, or five or more legs 50 disposed substantially equally around the circumference of the table 10. In other embodiments, such as shown in FIG. 8, the table 10 may not include any legs 50. In such embodiments, the table 10 may be positionable by a user such that the user may place and operate the table 10 on a flat surface, such as, for example, a floor, another table, or other supports.

In the illustrated embodiments, the top surface 12 of the table 10 is circular. However, the top surface 12 may have any suitable size, shape, or configuration. For example, the top surface 12 may be elliptical, triangular, square, pentagonal, hexagonal, or any other suitable shape. In some embodiments, the size, shape, and configuration of the top surface 12 of the table 10 may vary depending on the number of users or players (e.g., elliptical for two players, triangular for three players, square for four players, pentagonal for five players, etc.).

Figure 9A:
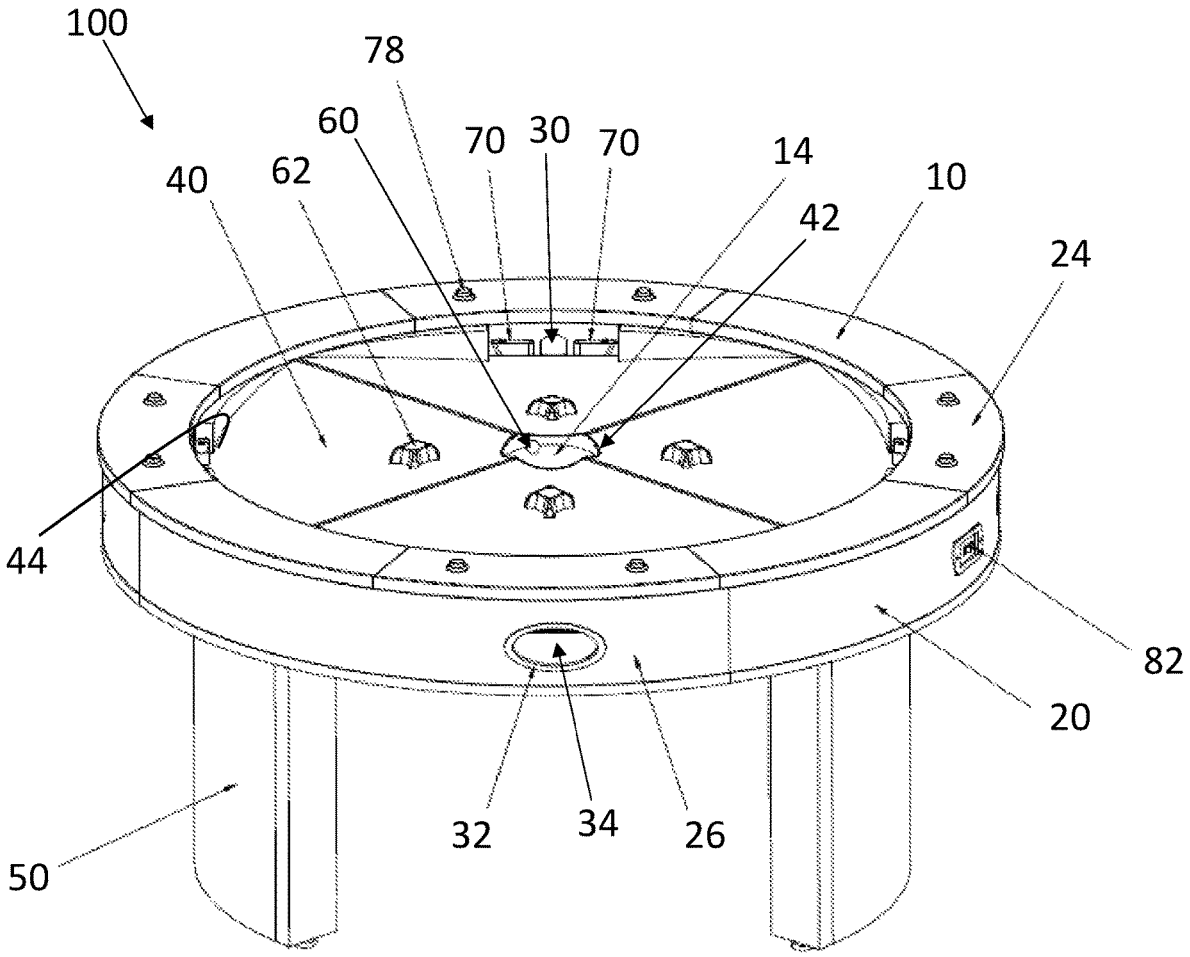
FIG. 9A illustrates a top perspective view of an exemplary table gaming system.
Figure 9B:
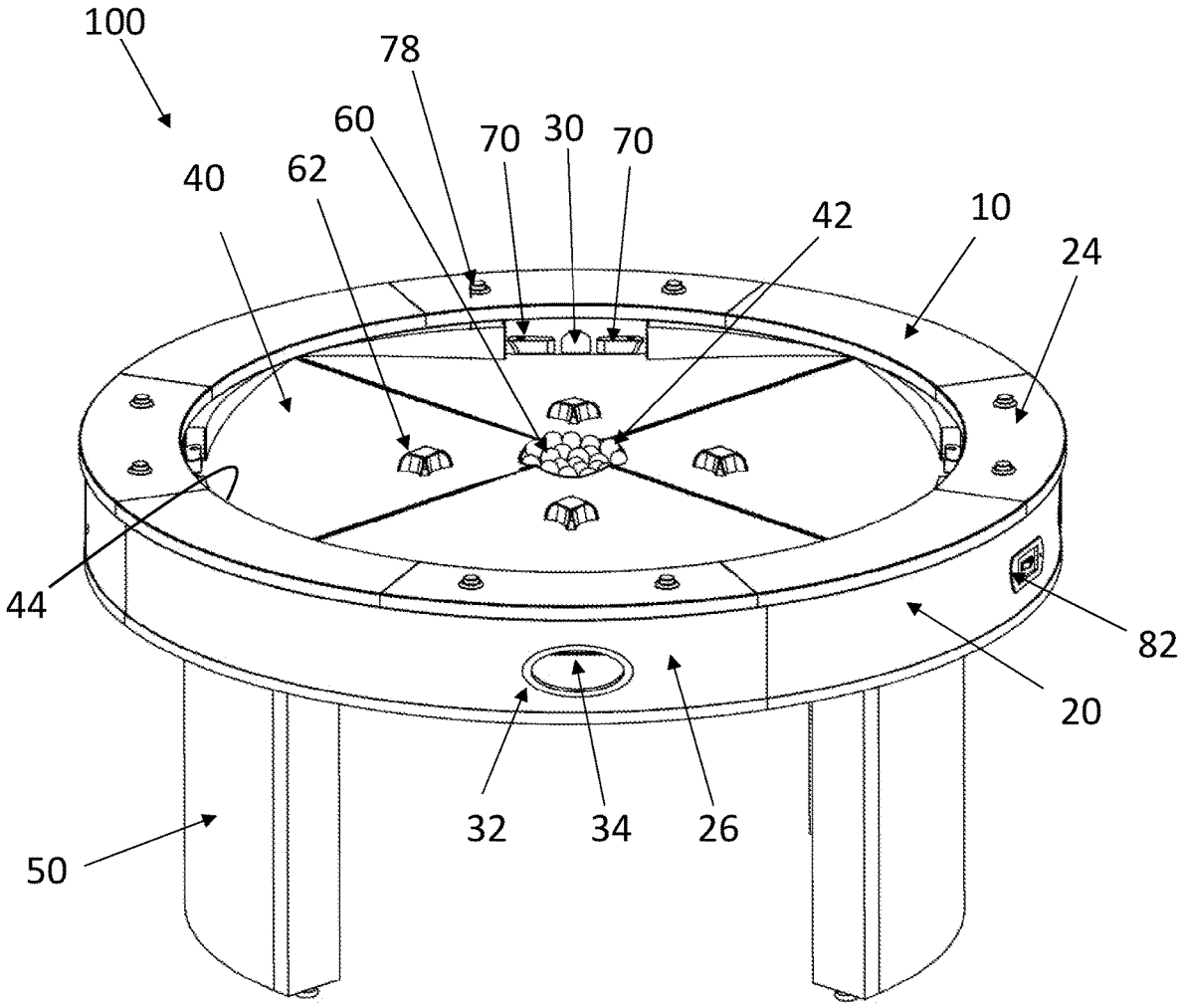
FIG. 9B illustrates a top perspective view of an exemplary gaming table system with a plurality of balls.
Figure 9C:
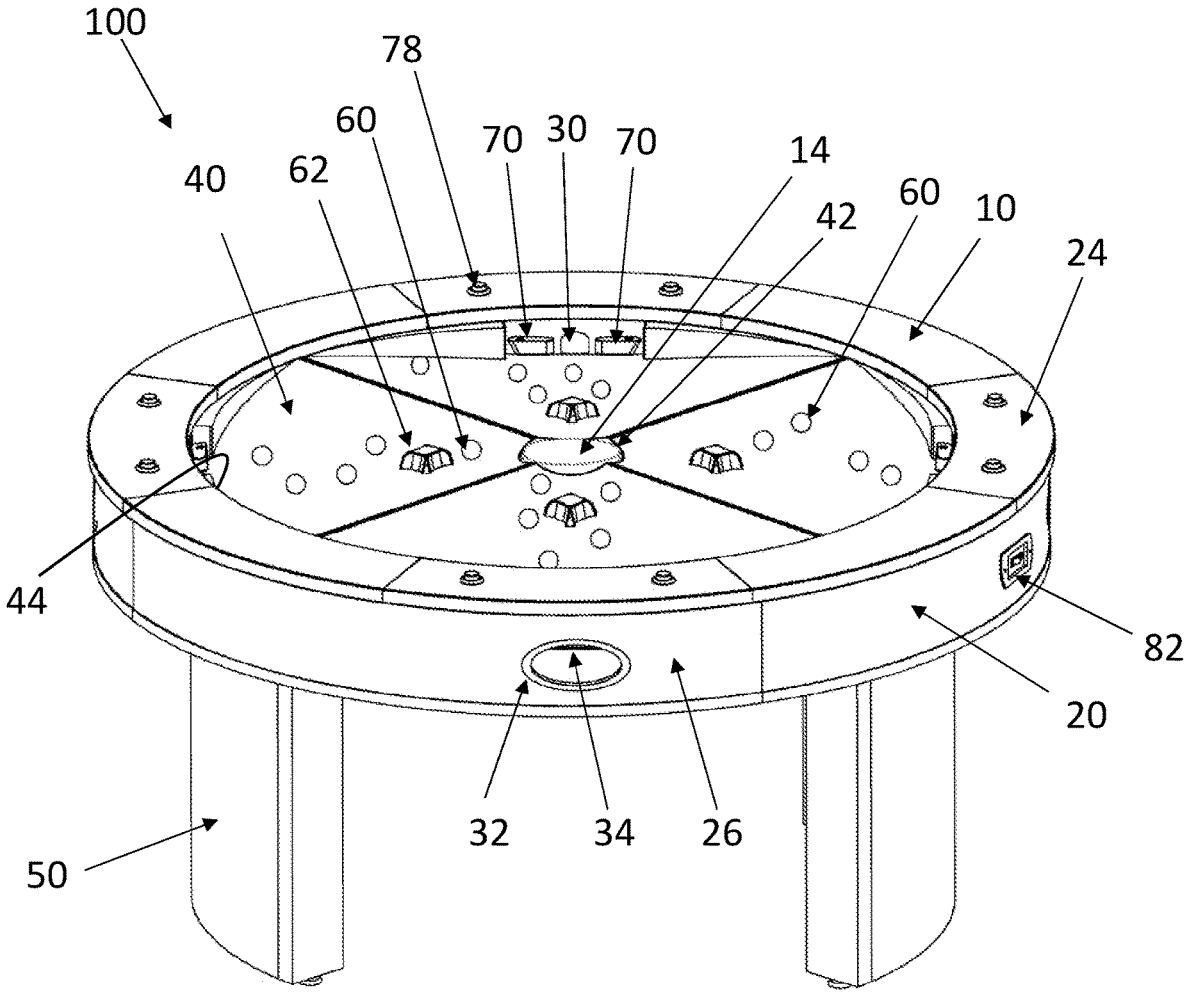
FIG. 9C illustrates a top perspective view of an exemplary gaming table system with a plurality of balls.
Figure 10:
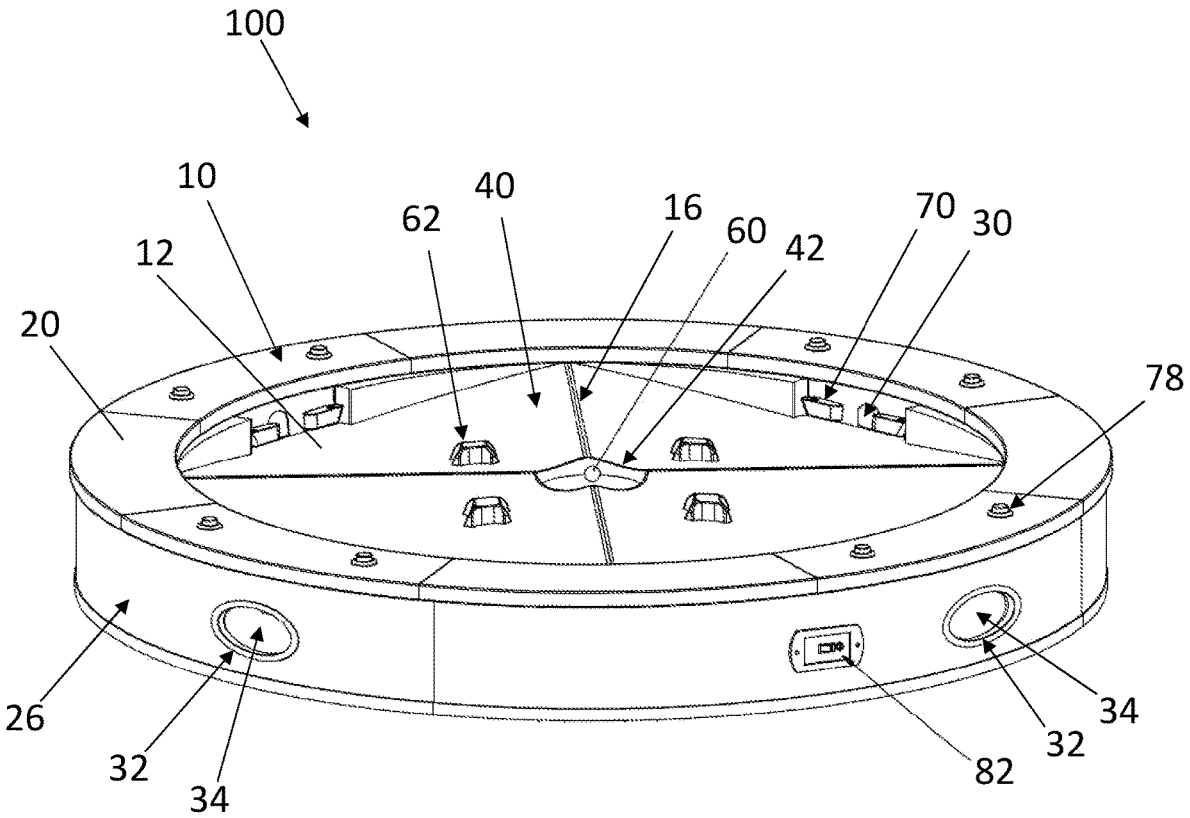
FIG. 10 illustrates a top perspective view of another exemplary table gaming system.

As shown in FIGS. 9 and 10, any of the above described tables 10 may be included in a gaming table system 100 including one or more balls 60 and an energy source which may supply power or energy to one or more components of the table 10. The energy source can be batteries, battery packs, power banks, or electric generators, connections or connectors to power outlets or sources, or any combination thereof. The balls 60 are spherical and sized to fit within the input apertures 30, as described below. The balls 60 may each have a diameter between about 0.5 inches and about 1.5 inches, such as between about 0.75 inches and 1.25 inches, such as about 1.0 inch. The gaming table system 100 may include any suitable number of balls 60. For example, the system 100 may include between 10 and 25 balls 60, such as between 15 and 20 balls 60, such as 18 balls 60. In some embodiments, the balls 60 are the same color. In other embodiments, the balls 60 may be different colors with a different number of balls 60 of each used color. The balls 60 of different colors may be worth different point values or scores when calculating the results of the game, as described below. For example, balls 60 of the color corresponding to the color with the most balls 60 may be worth the least number of points and balls 60 of colors corresponding to colors with fewer balls 60 may be worth more points.

Figure 11A:
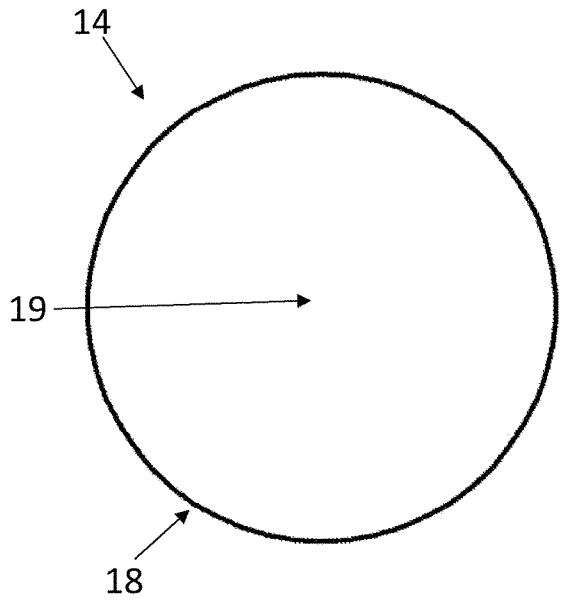
FIG. 11A illustrates a top view of an exemplary plateau.
Figure 11B:
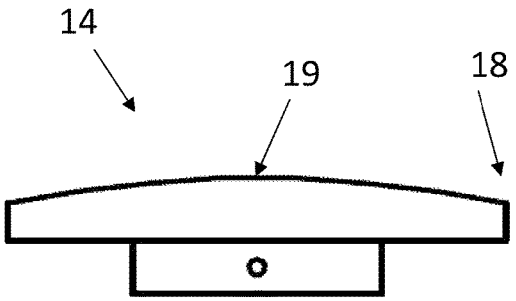
FIG. 11B illustrates a side view of the plateau of FIG. 9A.
Figure 11C:
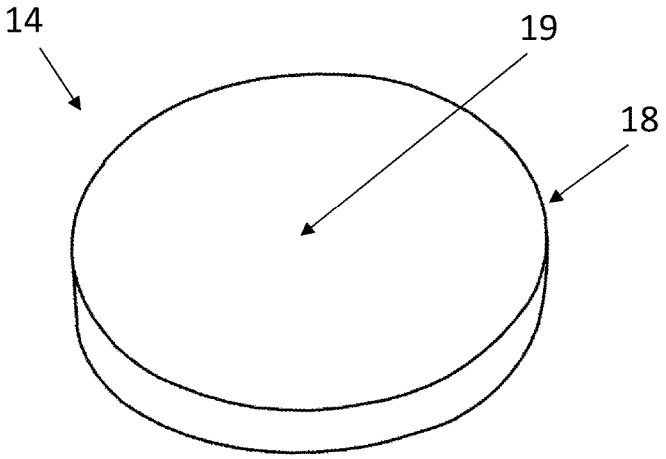
FIG. 11C illustrates a top perspective view of the plateau of FIG. 9A.
Figure 12A:
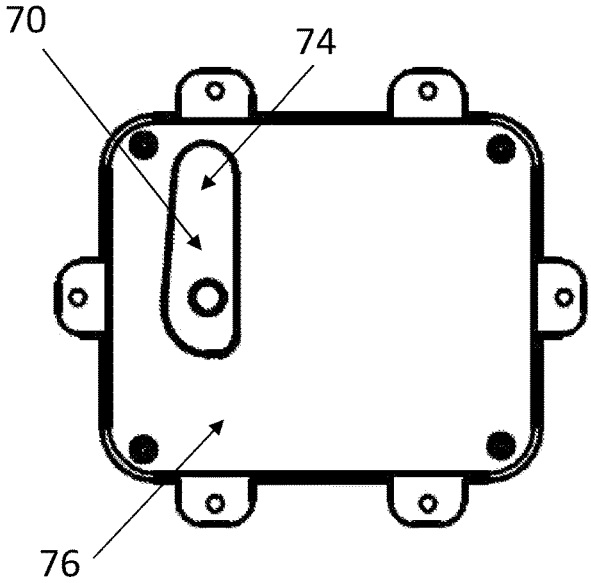
FIG. 12A illustrates a top view of an exemplary flipper.
Figure 12B:
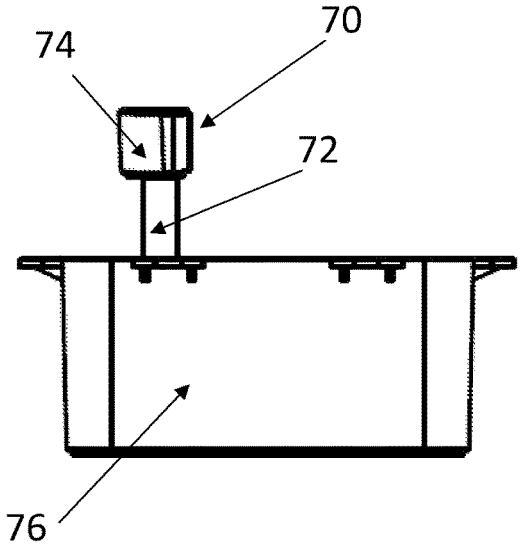
FIG. 12B illustrates a side view of the flipper of FIG. 10A.
Figure 12C:
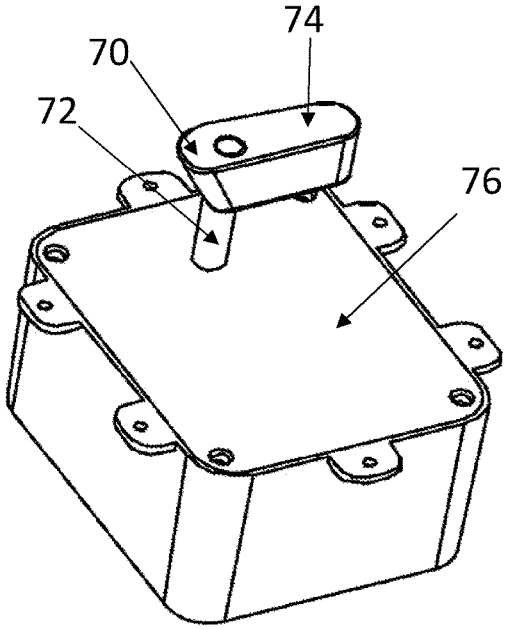
FIG. 12C illustrates a top perspective view of the flipper of FIG. 10A.
Figure 13A:
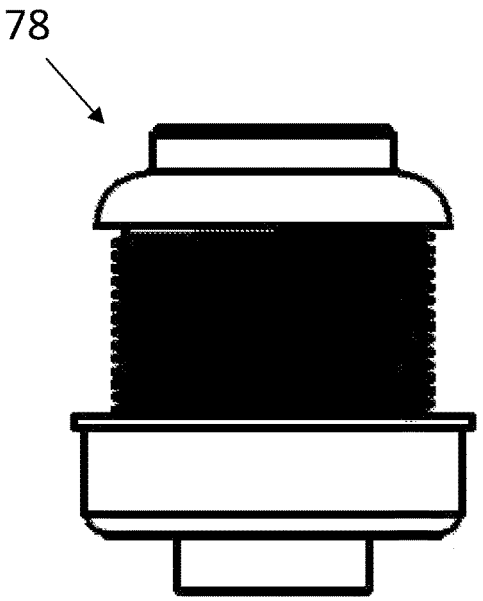
FIG. 13A illustrates a side view of an exemplary flipper actuation button.
Figure 13B:
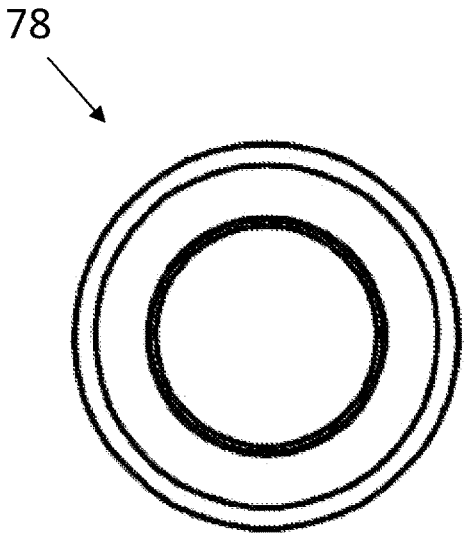
FIG. 13B illustrates a top view of the flipper actuation button of FIG. 11A.
Figure 13C:
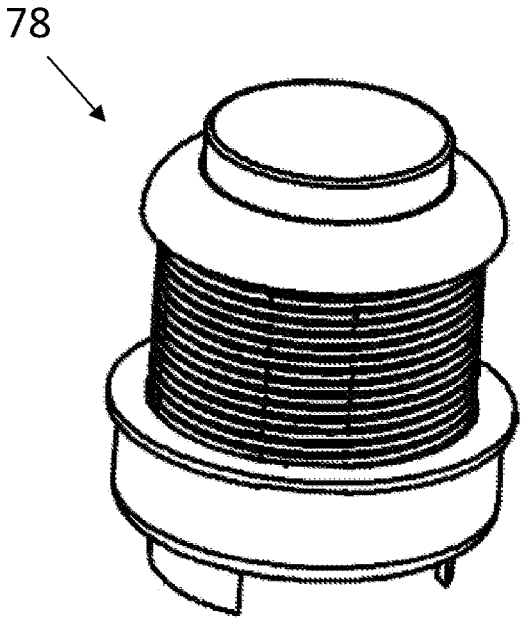
FIG. 13C illustrates a top perspective view of the flipper actuation button of FIG. 11A.
Figure 14A:
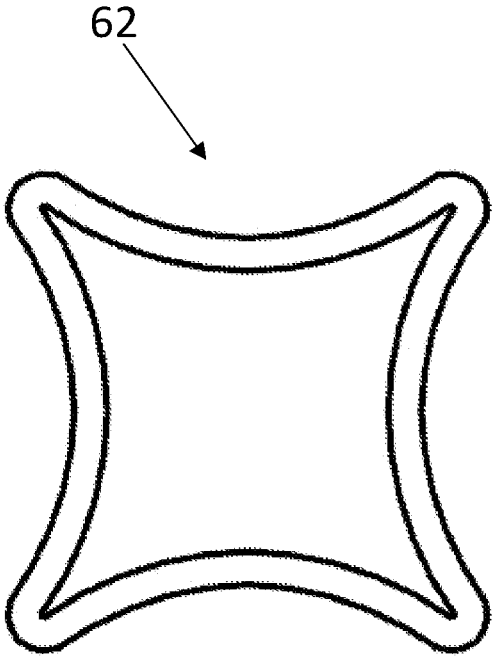
FIG. 14A illustrates a top view of an exemplary obstruction.
Figure 14B:
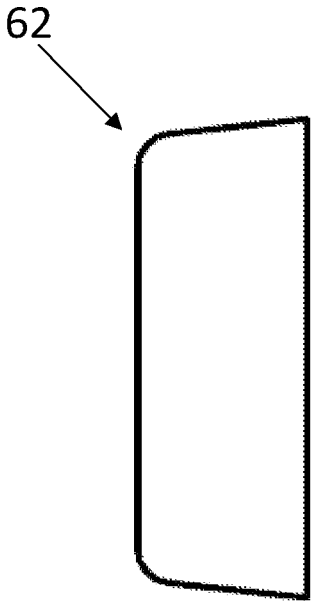
FIG. 14B illustrates a side view of the obstruction of FIG. 12A.
Figure 14C:
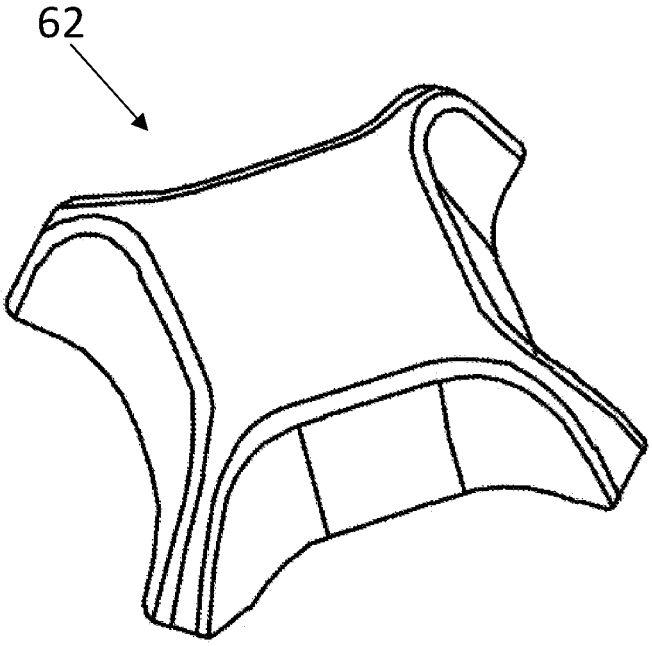
FIG. 14C illustrates a top perspective view of the obstruction of FIG. 12A.

Referring to FIGS. 1-10, the top surface 12 of the table 10 may be generally shaped, oriented, inclined, or otherwise configured to direct one or more playing objects or balls 60 toward the input apertures 30. The top surface 12 of the table 10 includes a platform or plateau 14 disposed substantially in the center of the top surface 12 and moveable between a first or lowered position below the other portions of the top surface 12 and a second or elevated position above the other portions of the top surface 12. The plateau 14 is generally sized, shaped, or otherwise configured such that one or more balls 60 placed on the plateau 14, such as at the beginning of the game, may roll toward each of the input apertures 30, such as due to gravity, when the plateau 14 is in the elevated position. In some embodiments, such as shown in FIGS. 11A-11C, the plateau 14 is sloped, tapered, rounded, or otherwise angled such that a perimeter 18 of the plateau 14 is disposed lower than a center point 19 of the plateau 14. For example, the perimeter 18 of the plateau 14 may be sloped, tapered, rounded, or otherwise angled such that the perimeter 18 of the plateau 14 is lower than the center point 19 of the plateau 14 such that the balls 60 roll or are otherwise moved toward the perimeter 18 of the plateau 14, such as by gravity. In other embodiments, the plateau 14 may be substantially flat.

In some embodiments, such as shown in FIGS. 9A-9C, the plateau 14 may be moved independently of the remainder of the top surface 12 to release one or more balls 60 disposed on the plateau 14 onto the remainder of the top surface 12, such as to begin a game. For example, the plateau 14 may be moveable from a first or lowered position lower than the height of the top surface 12 immediately surrounding the perimeter 18 of the plateau 14 to a second or raised position substantially equivalent to or slightly above the height of the top surface 12 immediately surrounding the perimeter 18 of the plateau 14. The first position may be substantially lower than the height of the top surface 12 immediately surrounding the perimeter 18 of the plateau 14 such that any ball 60 disposed on the plateau 14 may not roll or otherwise move off the plateau 14 and onto the remainder of the top surface 12. The second position may be a height substantially equivalent or slightly above the top surface 12 immediately surrounding the plateau 14 such that balls 60 disposed on the plateau 14 may smoothly roll or otherwise move off the plateau 14 and onto the remainder of the top surface 12 when the plateau 14 is moved to the second position.

Figure 15A:
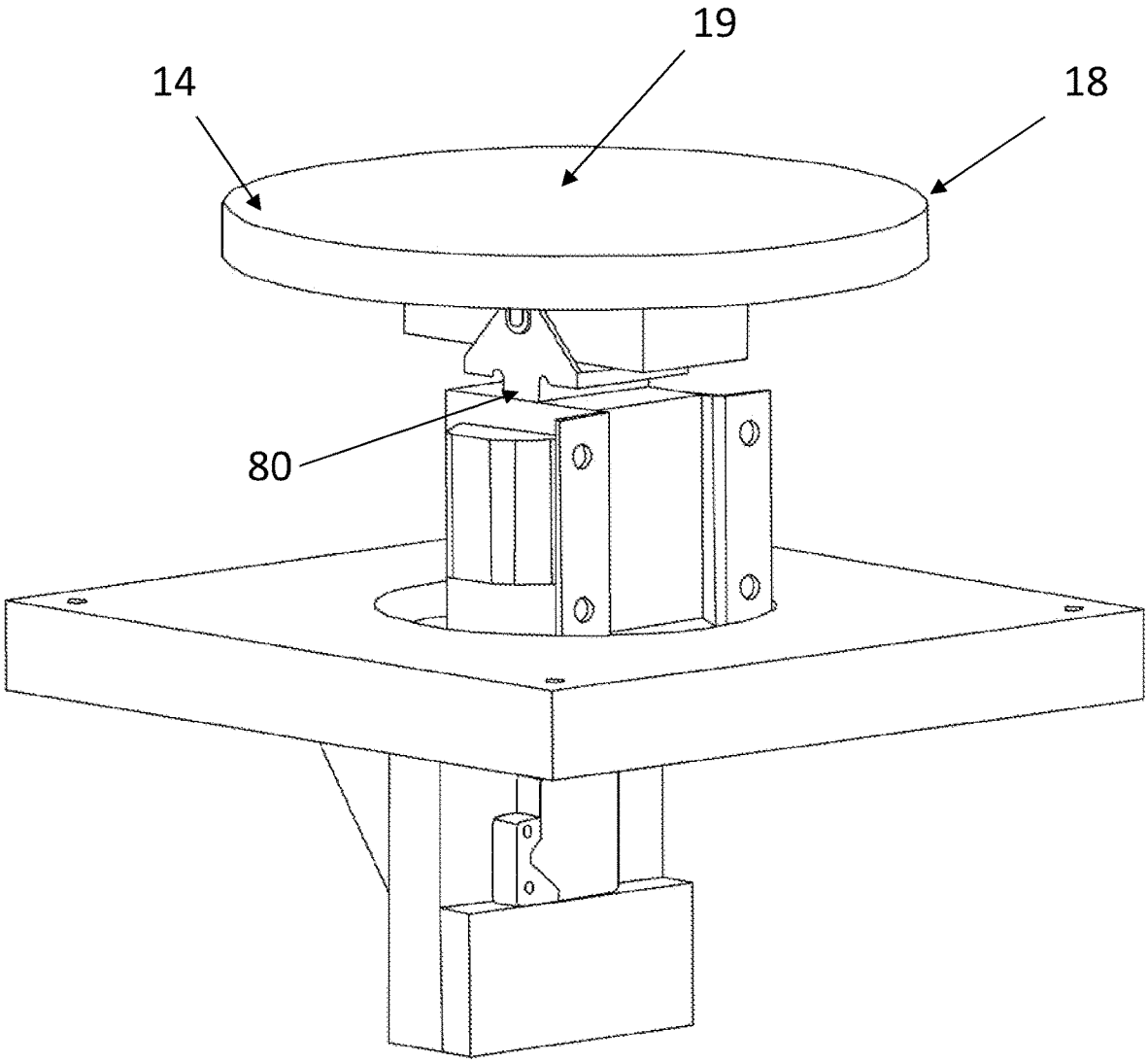
FIG. 15A illustrates a side view of the plateau of FIG. 11A connected to an exemplary actuator in a lowered position.
Figure 15B:
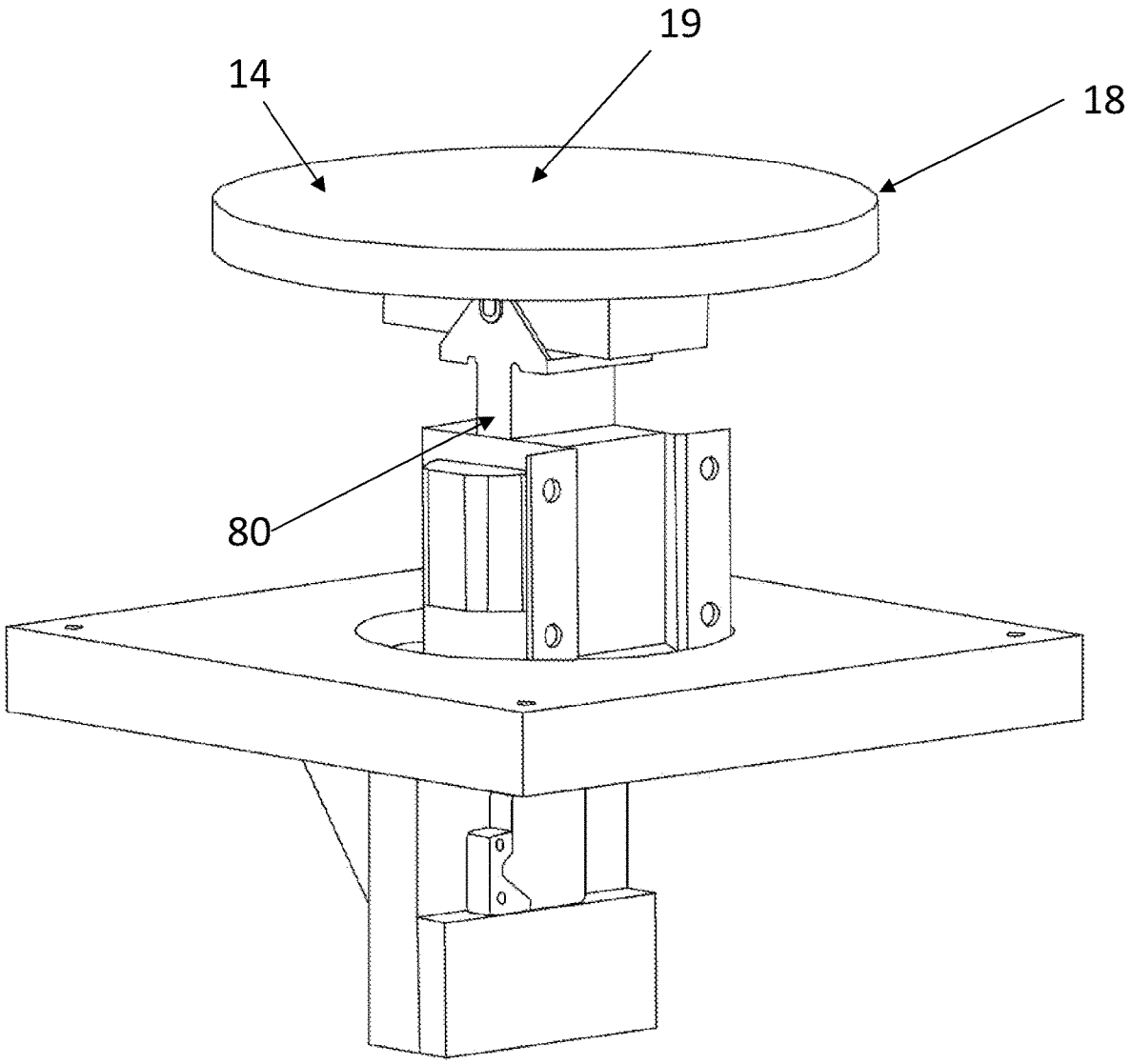
FIG. 15B illustrates a side view of the plateau of FIG. 11A connected to an exemplary actuator in a raised position.

As shown in FIGS. 15A and 15B, the plateau 14 may be connected to a motor or actuator 80 connected to an energy source and capable of moving the plateau 14 between the first and second positions. The energy source and/or the actuator 80 may be connected to a plateau activation button or switch 82 (FIGS. 1 and 8-10) which may be used to control the movement of the plateau 14 between the first and second positions. The plateau activation button 82 may be a button or switch which, when activated, causes the energy source and/or the actuator to move the plateau 14 between the first and second positions. The plateau activation button 82 may be disposed on any suitable location on the table 10. For example, the plateau activation button 82 may be disposed on the top wall 24 or outside wall 26 of the rail 20. In the illustrated embodiment, the plateau activation button 82 is disposed on the outside wall 26 of the rail 20. The actuator 80 may be a motor or solenoid with gears, piston, linear actuator, or other suitable lifting mechanisms connected to the plateau 14 and capable of moving the plateau 14 between the first and second positions when the actuator is supplied energy or power from the energy source. As shown in FIG. 15A, the plateau 14 may be disposed in the first or lowered position, such that the top surface of the plateau 14 is disposed below the remainder of the top surface 12 of the table 10. As shown in FIG. 15B, upon pressing, depressing, or activating the plateau activation button 82, such as by one of the users, the energy source may supply power to the actuator 80 to move the plateau 14, such as from the first position to the second position or from the second position to the first position. In other embodiments, the plateau 14 may be moved by one of the users, such as via a lever, lift, pulleys, crank, or other suitable mechanism.

While the plateau 14 has been described as being independently vertically moveable between a first position and a second position to release one or more balls 60 disposed on the plateau 14, the balls 60 disposed on the plateau 14 may be released via other suitable means. For example, one or more moveable lips may extend around the perimeter 18 of the plateau 14 and extend vertically to a height above the plateau 14 such that balls 60 disposed on the plateau 14 are prevented from rolling or otherwise moving off of the plateau 14 while the one or more lips are in position. The one or more lips may then be moved, such as by an actuation lever, solenoid, motor, or other similar mechanism to retract downwardly below the height of the perimeter 18 of the plateau 14, to pivot outwardly downwardly to lie flat against the portions of the top surface 12 adjacent to the perimeter 18 of the plateau 14, or to pivot outwardly in a gate-like fashion to create openings between the lips, such as to release one or more balls 60 disposed on the plateau 14.

In the illustrated embodiment, the plateau 14 is a circle. However, it will be appreciated that the plateau 14 may have any suitable size, shape, or geometry. For example, the plateau 14 may be triangular, square or rectangular, pentagonal, hexagonal, or any other suitable shape. In some embodiments, the plateau 14 is a shape having a number of sides or edges corresponding to the number of desired users. For example, the plateau 14 may be triangular in embodiments of the table 10 configured for three uses or may be square in embodiments of the table 10 configured for four users, with the orientation of the plateau 14 evenly oriented or positioned with respect to the users, such as with each side of the plateau 14 directly facing one of the users and/or input apertures 30 or with each corner of the plateau 14 being directly in front of one of the users and/or input apertures 30.

As shown in FIGS. 1-10, the remainder of the top surface 12 beyond the plateau 14 may be shaped, sized, or otherwise configured to direct one or more balls 60 which roll off the plateau 14 toward one or more of the input apertures 30. The top surface 12 may be generally sloped, rounded, tapered, or otherwise angled downwardly from the plateau 14 toward the rail 20 and toward the one or more input apertures 30 such that one or more balls 60 released from the plateau 14 may roll or otherwise move from the plateau 14 toward the rail 20 and/or the one or more input apertures 30, such as by gravity. For example, as shown in FIG. 9B, a plurality of balls 60 may be disposed on the plateau 14 in the first or lowered position and, as shown in FIG. 9C, the plateau 14 may be moved to the second or raised position and the plurality of balls 60 may be released or otherwise roll from the plateau 14 toward the rail 20 and/or the one or more input apertures 30.

The top surface 12 of the table 10 may also include one or more ridges 16 extending between the plateau 14 and the edge 15 of the top surface 12. The ridges 16 may extend radially outward from the plateau 14 to the inside wall 22 of the rail 20 and may be evenly spaced around the circumference of the top surface 12 substantially between the input apertures 30. Each ridge 16 has an apex which may be higher than the remainder of the top surface 12 and the ridges 16 may be sloped, rounded, tapered, or otherwise angled downwardly from the apex toward the remainder of top surface 12 such that balls 60 on the ridges 16 may roll or otherwise move toward one of the input apertures 30. The ridges 16 extend radially outwardly from the plateau 14 at a first height adjacent to the plateau 14 to a second height adjacent to the inside wall 22 of the rail 20. In some embodiments, the first height of the ridges 16 is substantially equal to the height of the plateau 14 in the second or starting position and the second height of the ridges 16 is substantially equivalent to the first height of the ridges 16. However, it will be appreciated that the ridges 16 may have any suitable size, shape, or configuration. For example, the first height of the ridges 16 may be higher than the second or starting position of the plateau 14 to prevent balls 60 from rolling off the plateau 14 and onto the ridges 16, the first height of the ridges 16 may be lower than the second or starting position of the plateau 14, the second height of the ridges 16 may be substantially the same as the first height of the ridges 16, or the second height of the ridges 16 may be below the first height of the ridges 16. In the illustrated embodiment, each ridge 16 extends in a substantially straight line from the plateau 14 to the edge 15 of the top surface 12. However, it will be appreciated that each ridge 16 may have any suitable shape, geometry, or configuration. For example, the ridges 16 may be curved, may be triangular with a wider portion near the perimeter 18 of the top surface 12 than near the plateau 14, may be a zig-zag shape, or have any other suitable shape, geometry, or configuration.

As shown in FIGS. 1-10, the plateau 14, the apex of two adjacent ridges 16, and the inside wall 22 may define a plurality of table sections 40 in the top surface 12. Each table section 40 corresponds to one of the input apertures 30. Each table section 40 is generally a trapezoid or truncated triangle with an inside edge 42 adjacent to the plateau 14, an outside edge 44 adjacent to the rail 20, a first side edge 46, and a second side edge 48 opposite the first side edge 46. The apices of the two adjacent ridges 16 may define the first and second side edges 46, 48 of the table section 40 disposed therebetween. In the illustrated embodiment, the inside edge 42 is curved or rounded and generally corresponds to the perimeter 18 of the plateau 14 and the outside edge 44 is curved or rounded and generally corresponds to the inside wall 22 of the rail 20. While the inside and outside edges 42, 44 are described as being curved or rounded, it will be appreciated that the inside and outside edges 42, 44 may have any suitable shape for geometry. For example, the inside edge 42 may be straight or have two straight portions which connect at a corner in embodiments where the plateau 14 is not circular and is triangular, square, or other suitable shape and the outside edge 44 may be straight or have two straight portions which connect at a corner in embodiments where the table 10 is not circular and is triangular, square, or other suitable shape.

The table sections 40 may be sized, shaped, or otherwise configured to substantially direct one or more balls 60 from the plateau 14 toward the input apertures 30. The table sections 40 may be sized, shaped, or otherwise configured such that balls 60 may roll from the first and second side edges 46, 48 toward the middle or center of the table section 40 and from the inside edge 42 downwardly toward the outside edge 44. Each of the table sections 40 may be sized, shaped, and positioned such that one of the input apertures 30 is substantially aligned with and disposed above the middle of the outside edge 44 of the table section 40. The outside edge 44 of the table section 40 may be configured and at a height such that balls 60 rolling on the table section 40 may roll directly into the input aperture 30. Each table section 40 slopes downwardly from the inside edge 42 to the outside edge 44 such that at least a center portion of the outside edge 44 is disposed lower than the inside edge 42. Each table section 40 also slopes or is rounded downwardly from the first and second side edges 46, 48 toward the center of the table section 40 forming a general U or half-pipe shape.

In the illustrated embodiment, the table 10 includes four table sections 40. However, it will be appreciated that the table 10 may include any number of table sections 40 corresponding to the desired number of users for the table 10. For example, the table 10 may include two table sections 40 for two users, three table sections 40 for three users, five table sections 40 for five users, and so on.

As shown in FIGS. 1-10 and 12A-13C, the table 10 also includes one or more bumpers or flippers 70 near each of the input apertures 30, such as on opposite sides of the input apertures 30, which may be actuated or otherwise moved such that the 70 may at least partially hit, block, or deflect balls 60 from rolling into the respective input aperture 30. Each flipper 70 includes a base 72 affixed to the top surface 12 or rail 20 and a projection 74 extending laterally from the base 72 toward the input aperture 30. The flippers 70 are actuatable or moveable such that the base 72 may pivot about a connection to or through the top surface 12 or rail 20 and the projection 74 may pivot or rotate about the base 72 from a first orientation substantially flat against the rail 20 to a second orientation angled radially outward from the rail 20 such that the projection 74 may hit, block, or deflect one of the balls 60 when the flipper 70 is moved from the first orientation to the second orientation. The flippers 70 may be sized, shaped, or otherwise configured such that at least a portion of the adjacent input aperture 30 is not covered or blocked by the projections 74 of the adjacent flippers 70. The uncovered or unblocked portion of the input aperture 30 may be large enough for at least one of the balls 60 to pass therethrough. In some embodiments, the projection 74 of each flipper 70 extends from the base 72 to a point distal to or before the nearest edge of the input aperture 30 such that the projection 74 does not extend or cover any portion of the input aperture 30. In other embodiments, the projection 74 of each flipper 70 extends from the base 72 to a point medial to or beyond the nearest edge of the input aperture 30 such that a portion of the projection 74 extends or covers a portion of the input aperture 30. The projection 74 of each flipper 70 may have a length extending toward the input aperture 30 between about 50 mm and about 100 mm, such as between about 65 mm and 80 mm, such as about 27 mm.

The flippers 70 may be actuatable or movable between the first and second orientations via mechanical and/or electric operation. Each of the flippers 70 may be connected to the energy source and a flipper actuator or motor 76 such that, when energy is supplied from the energy source to the flipper actuator 76, the flipper actuator 76 moves the flipper 70 from the first orientation to the second orientation. The flipper actuator 76 may be any actuator capable of moving the flipper 70 from the first orientation to the second orientation, such as a solenoid and/or spring. For example, the flipper actuator 76 may be actuators known in the art for use in pinball machines. The flippers 70 may also include a spring or other biasing member which returns the flipper 70 from the second orientation back to the first orientation after the energy is no longer supplied from the energy source to the flipper actuator 76.

Each of the flippers 70 and/or flipper actuators 76 may be connected to a flipper activation button or switch 78 such that, when the flipper actuation button 78 is pressed, depressed, or otherwise activated, such as by a user, the energy source connects to the flipper actuator 76 and/or the flipper actuator 76 is actuated to move the flipper 70 from the first orientation to the second orientation. When the flipper actuation button 78 is no longer pressed or depressed, such as when the user removes his or her hand, the flipper actuator 76 may be deactivated, such as by the energy source no longer supplying energy to the flipper actuator 76, and the flipper 70 may move from the second orientation to the first orientation.

While the flippers 70 have been described as being actuatable or moveable between the first and second orientations via mechanical operation upon a user activating one of the flipper actuation buttons 78, the flippers 70 may be actuatable or movable in any suitable manner. For example, each flipper 70 may be manually actuatable or moveable by a user, such as via a lever, shaft, crank, knob, or directly by hand.

Referring to FIGS. 1-10 and 14A-14C, the table 10 may include one or more obstacles or obstructions 62 disposed on the top surface 12 of the table 10 between the plateau 14 and the rail 20 to block or deflect balls 60 released from the plateau 14 or otherwise moving or rolling on the top surface 12. In some embodiments, the table 10 may include at least one obstruction 62 disposed substantially between the plateau 14 and each of the input apertures 30 such as to stop, block, impede, or otherwise obstruct one or more balls 60 released from the plateau 14 from rolling or otherwise moving directly from the plateau 14 to the input apertures 30. However, the table 10 may include any number of obstructions 62 in any suitable configuration. For example, the table 10 may also include obstructions 62 between each input aperture 30 and each ridge 16 such that balls 60 rolling or otherwise moving down the ridges 16 may be stopped, blocked, impeded, or otherwise obstructed from rolling or otherwise moving directly from the ridge 16 to the input aperture 30.

In the illustrated embodiment, the obstructions 62 are generally round corner concave squares or diamonds. However, it will be appreciated that the obstructions 62 may have any suitable size, shape, or configuration. For example, the obstructions 62 may be circles, ovals, triangles, squares, rectangles, pentagons, hexagons, stars, or any other suitable shape.

In some embodiments, the obstructions 62 may be affixed to the top surface 12. In other embodiments, the obstructions 62 may be modular such that the obstructions 62 may be removed from the top surface 12 and/or table sections 40 and may be replaced with different obstructions 62. Each of the obstructions 62 may include a connector or fastener, such as a screw or magnet, disposed on the bottom of the obstruction 62 and the top surface 12 may have one or more reciprocal connectors or fasteners, such as threaded bores or oppositely charged magnets, disposed on or in multiple locations on the top surface 12 to receive and fasten the obstructions 62 in any desired locations.

In some embodiments, the obstructions 62 are stationary once disposed or affixed on the top surface 12 of the table 10. In other embodiments, one or more of the obstructions 62 may be non-stationary or otherwise actuated, such as via a connection with the energy source. For example, one or more of the obstructions 62 may be connected to the energy source to light up, change colors, spin or rotate, or move vertically up and down relative to the top surface 12. The obstructions 62 may light up, change colors, spin or rotate, or move vertically up and down according to any suitable event. For example, the obstructions 62 may move, spin, light up, or otherwise be activated upon contact with one or more of the balls 60, upon one or more balls 60 entering the input aperture 30 corresponding to that table section 40, upon expiration of a timer, upon expiration of the game, periodically according to a timer, upon the user's activation of the flippers 70 corresponding to that table section 40, or any other suitable event.

In some embodiments, the table 10 may be modular, such as to accommodate varying numbers of players. The table system 100 may include a plurality of table sections 40 corresponding to the desired number of players. For example, the table system 100 may include two table sections 40 that are each make up one half of the table 10 for use with two players, three table sections 40 that each make up one third of the table 10 for use with three players, four table sections 40 that each make up one fourth of the table 10 for use with four players, and so on. Each table section 40 may be a separate part or leaf of the table 10 such that the table section 40 may be removed or inserted onto the table 10. The desired table sections 40 may be placed onto the table 10 by a user such that the top surface 12 is complete and substantially fills the area between the plateau 14 and the rail 20. The table sections 40 may fit together or be secured by any suitable means such as by snap fit, dovetail connections, shiplap, V-groove or by fasteners.

The rail 20 may also be modular or adjustable to accommodate varying numbers of players. The inside wall 22 of the rail 20 may include a plurality of moveable or replaceable panels such that input apertures 30 and flippers 70 may be moved, adjusted, removed, or added corresponding to the number of table sections 40 and such that each input aperture 30 may be substantially aligned with the center of the outside edge 44 of one of the table sections 40. The top wall 24 of the rail 20 may also include a plurality of moveable or replaceable panels such that the flipper actuation buttons 78 may be moved, adjusted, removed, or added to correspond to the number of table sections 40 and desired players. In such embodiments, the table 10 may include one or more fixed collection chambers 34 and one or more fixed retrieval apertures 32 such that users may retrieve balls 60 from the one or more collection chambers 34 regardless of the configuration of input apertures 30. For example, the table 10 may include a single collection chamber 34 which extends around the circumference of the table 10 such that a ball 60 that enters through one of the input apertures 30 in any location may be collected in the collection chamber 34. The bottom surface of the collection chamber 34 may be sloped or angled one or more retrieval apertures 32 may be disposed in the outside wall 26 corresponding to the lowest portions of the collection chamber 34 such that balls 60 that pass through any of the input apertures 30 may roll, such as by gravity, to the lowest portions of the collection chamber 34 and be retrievable by a user.

In some embodiments, such as shown in FIGS. 9A and 9B, one or more balls 60 may be placed or disposed on the plateau 14 when the plateau 14 is in the first position or before the balls 60 are otherwise released from the plateau 14. In some embodiments, one or more users place one or more balls 60, such as from the collection chamber 34, onto the plateau 14. However, it will be appreciated that the balls 60 may be moved to the plateau 14 in any suitable manner. For example, the table 10 may also include one or more conveyors or conveyor systems connected to the energy source which automatically conveys or moves one or more balls 60 to the plateau 14. The conveyors or conveyor systems may move one or more balls 60 from a supply or one or more collection chambers 34 to the surface of the plateau 14, such as by belts, rollers, pushers, or any other suitable conveyor. Each collection chamber 34 may be in communication with a conveyor such that balls 60 that have gone through each of the input apertures 30 may be conveyed or otherwise moved to the surface of the plateau 14 to be rereleased onto the top surface 12. The conveyors or conveyor systems may be disposed substantially above the top surface 12 such that balls 60 may be conveyed and dropped onto the surface of the plateau 14 or the conveyors may be disposed below the top surface 12 and convey the balls 60 to the surface of the plateau 14, such as through an opening in the plateau 14.

In the illustrated embodiment, the top wall 24 of the rail 20 is substantially flat except for the flipper actuation buttons 78. However, the top wall 24 of the rail 20 may include one or more additional features. For example, the top wall 24 of the rail 20 may include one or more cup holders inset in the top wall 24 to accommodate beverage containers, one or more display panels, such as LED, touch screens, or other digital displays, such as to provide scores or a timer, counters to keep score, speakers, and/or holders for tablets and/or phones.

Figure 16:
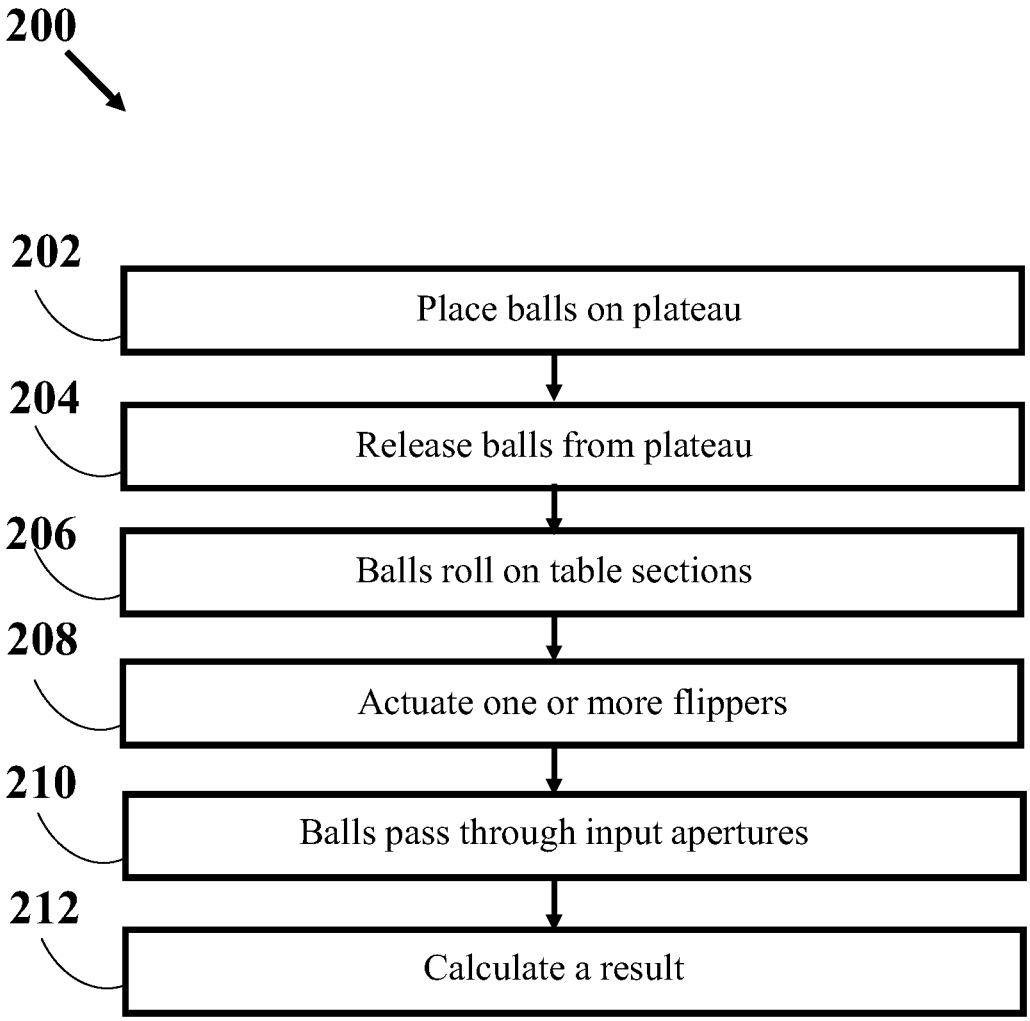
FIG. 16 shows an exemplary method for using a gaming table.

FIG. 16 shows steps according to an exemplary method 200 for using a gaming table. It will be appreciated that the illustrated method and associated steps may be performed in a different order, with illustrated steps omitted, or additional steps. The steps may be performed on or using a gaming table, such as on gaming table 10.

At step 202, one or more balls 60 may be placed on a plateau 14 of the gaming table 10. The balls 60 may be placed on the plateau 14 such that the balls 60 remain disposed on and do not roll off the plateau 14. In some embodiments, the balls 60 may be placed or disposed on the plateau 14 by one or more users, such as by hand. The balls 60 may be retrieved from a supply and/or the collection chamber 34 of the table 10, such as through one or more retrieval apertures 32. In other embodiments, the balls 60 may be placed on the plateau 14 of the table 10 by other means. For example, the balls 60 may be moved from a supply or one or more collection chambers 34 by one or more conveyors or conveyor systems.

At step 204, the one or more balls 60 may be released from the plateau 14 of the gaming table 10. The one or more balls 60 may be released from the plateau 14 such that they roll off the plateau 14 and onto the remainder of the top surface 12 of the gaming table 10. In some embodiments, the balls 60 may be placed on the plateau 14 when the plateau 14 is in a first position disposed below the portions of the top surface 12 immediately surrounding the plateau 14 and the plateau 14 may be moved to a second position above the portions of the top surface 12 immediately surrounding the plateau 14 such that the balls 60 may roll off the plateau 14 and onto the other portions of the top surface 12. The plateau 14 may be moved from the first position to the second position by supplying energy from an energy source to an actuator to raise the plateau 14, such as by actuating a plateau activation button 82. Alternatively, the plateau 14 may be moved by one of the users, such as via a lever, lift, crank, or other suitable mechanism. In other embodiments, the balls 60 may be retained on the plateau 14 by one or more moveable lips which extend around the perimeter 18 of the plateau 14 and the balls 60 may be released to the other portions of the top surface 12 by lowering, pivoting, or opening the one or more lips.

At step 206, the one or more balls 60 released from the plateau 14 may roll the table sections 40 of the gaming table 10. The table sections 40 may be sized, shaped, and configured to direct balls 60 rolling on the table section 40 toward an input aperture 30 disposed in the inside wall 22 of the rail 20 surrounding the top surface 12. The balls 60 may roll down each of the table sections 40 from first and second side edges 46, 48 toward the middle of the table section 40 and from the inside edge 42 down to the outside edge 44 toward the input aperture 30 positioned at a center point of the outside edge 44. In some embodiments, the table sections 40 include obstructions 62 which deflect, hit, or stop one or more balls 60 rolling on the table section 40. For example, one or more obstructions 62 may be disposed between the plateau 14 and the input aperture 30 to deflect or prevent one or more balls 60 from rolling directly off the plateau 14 and through the input aperture 30.

At step 208, one or more flippers 70 may be actuated between a first orientation and a second orientation to hit, strike, or deflect balls 60 which roll near the input aperture 30 corresponding to the table section 40. Players or users may be positioned on the opposite side of the rail 20 from each table section 40 and/or input aperture 30. Each user may actuate the flippers 70 corresponding to his or her table section 40 and/or input aperture 30 to defend the input aperture 30, attempting to allow the least number of balls 60 possible through the input aperture 30. Each user may actuate the flippers 70 next to his or her input aperture 30 to hit or deflect as many balls 60 as possible from entering the input aperture 30. In some embodiments, each flipper 70 may be moved between the first and second orientations by a user, such as by hand. In other embodiments, each flipper 70 may be moved from the first orientation to the second orientation by supplying energy from an energy source to a flipper actuator 76, such as by pressing or depressing a flipper actuation button 78 corresponding to the flipper 70. The flipper 70 may move from the second orientation to the first orientation when the flipper actuation button 78 is released, such as by a biasing member. The flippers 70 may hit the balls 60 away from the input aperture 36 and back up the table section 40 or to other table sections 40 such that the balls may continue rolling on the top surface 12.

At step 210, one or more balls 60 may pass through one or more input apertures 30 adjacent to the top surface 12 and disposed in the inside wall 22 of the rail 20. The balls 60 may roll on the table sections 40 and be struck by one or more flippers 70 until the ball 60 passes through the opening between the flippers 70 and through one of the input apertures 30. The space between the flippers 70 may be large enough for balls 60 to pass therethrough. This step may continue until all of the balls 60 released from the plateau 14 have passed through one of the input apertures 30, such as into the collection chambers 34.

At step 212, results or scores are calculated corresponding to the number of balls 60 that passed through each input aperture 30. The winner may be the user with the lowest score according to the balls 60 which passed through the respective input aperture 30 and the loser may be the user with the largest score according to the balls 60 which passed through the respective input aperture 30. Each of the input aperture 30 may include a counter, such as a light gate, which counts the number of balls 60 which pass through the input aperture 30. Alternatively, users may count the balls 60 contained in each of the collection chambers 34 corresponding to the input aperture 30 to calculate the score. In some embodiments, the score is determined based directly on the number of balls 60 which pass through the respective input apertures 60. In other embodiments, different balls 60 have different point values, such as corresponding to the color of the ball, and the scores are calculated based on the point value corresponding with each ball 60. The winner of the game may be the user with the fewest points and the loser of the game may be the user with the most points after all of the balls 60 released from the plateau 14 have passed through one of the input apertures 30.

While various inventive aspects, concepts and features of the disclosures can be described and illustrated herein as embodied in combination in the examples herein, these various aspects, concepts, and features can be used in many alternative examples, either individually or in various combinations and sub-combinations thereof. Unless expressly excluded herein all such combinations and sub-combinations are intended to be within the scope of the present application. Still further, while various alternative examples as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative examples, whether presently known or later developed. Those skilled in the art can readily adopt one or more of the inventive aspects, concepts, or features into additional examples and uses within the scope of the present application even if such examples are not expressly disclosed herein.

Additionally, even though some features, concepts, or aspects of the disclosures may be described herein as being a preferred arrangement or method, such description is not intended to suggest that such feature is required or necessary unless expressly so stated. Still further, example or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of example methods or processes are not limited to inclusion of all steps as being required in all cases, nor is the order that the steps are presented to be construed as required or necessary unless expressly so stated. The words used in the claims have their full ordinary meanings and are not limited in any way by the description of the examples in the specification.

What is claimed is:

1. A gaming table comprising:

a top surface including a plateau disposed in a center of the top surface and a plurality of table sections disposed around the plateau;

a rail disposed around the top surface and including an inside wall, a top wall, and an outside wall, the inside wall including an input aperture disposed adjacent to a center of an outside edge of each table section;

flippers disposed on opposite sides of the input apertures; and a flipper actuation button corresponding to each flipper;

wherein the plateau is moveable between a first position lower than a remainder of the top surface and a second position higher than the remainder of the top surface; and wherein activation of each flipper actuation button moves the flipper between a first orientation and a second orientation.

2. The gaming table of claim 1, further comprising an obstruction disposed on each table section.

3. The gaming table of claim 2, wherein the obstructions are disposed on the table sections between the plateau and the input apertures.

4. The gaming table of claim 1, wherein each table section also includes an inside edge, a first side edge, and a second side edge; and wherein the inside edges are disposed higher than the outside edges and the first side edges and the second side edges are disposed higher than a medial portion of each table section.

5. The gaming table of claim 4, wherein the first side edge of each table section and the second side edge of an adjacent table section define a ridge.

6. The gaming table of claim 1, further comprising an actuator capable of moving the plateau from the first position to the section position.

7. The gaming table of claim 1, wherein the plateau includes a center point and a perimeter; and wherein the perimeter is disposed below the center point.

8. The gaming table of claim 1, wherein the table sections are removeable from the gaming table.

9. A gaming table system comprising:

a plurality of balls;

an energy source; and a gaming table comprising:

a top surface with a plateau in a center of the top surface and a plurality of table sections disposed around the plateau;

a rail disposed around the top surface and including an inside wall, a top wall, and an outside wall, the inside wall including an input aperture disposed adjacent to a center of an outside edge of each table section;

flippers disposed on opposite sides of the input apertures and moveable between a first orientation and a second orientation;

wherein the plateau is moveable between a first position lower than a remainder of the top surface and a second position higher than the remainder of the top surface; and wherein the energy source is configured to supply energy to move the plateau from the first position to the second position and to move the flippers from the first orientation to the second orientation.

10. The gaming table system of claim 9, wherein the energy source is connected to an actuator capable of moving the plateau from the first position to the second position.

11. The gaming table system of claim 9, wherein when the plurality of balls are placed on the plateau in the first position, the plurality of balls roll from the plateau to the table sections when the plateau is moved to the second position.

12. The gaming table system of claim 9, wherein the table sections are configured to direct balls from the table section to the input apertures.

13. The gaming table system of claim 9, wherein each table section also includes an inside edge, a first side edge, and a second side edge; and wherein the inside edges are disposed higher than the outside edges and the first side edges and second side edges of each table section are disposed higher than a medial portion of each table section.

14. The gaming table system of claim 9, wherein the table sections are removeable from the gaming table.

15. The gaming table system of claim 14, wherein the table sections are modular to accommodate varying numbers of users.

16. A method for using a gaming table, the method comprising the steps:

placing a plurality of balls on a plateau of a top surface of the gaming table;

releasing the plurality of balls from the plateau;

allowing the balls to roll from the plateau onto at least two table sections of the gaming table;

actuating a flipper between a first orientation and a second orientation;

allowing the balls to pass through input apertures corresponding to each table section; and scoring a result;

wherein the step of releasing the plurality of balls from the plateau includes moving the plateau from a first position disposed lower than a remainder of the top surface to a second position disposed higher than the remainder of the top surface.

17. The method of claim 16, wherein obstructions are disposed on each table section to prevent the balls from rolling directly from the plateau through the input apertures.

18. The method of claim 16, wherein the step of scoring the result includes counting a number of balls of a color and multiplying the number of balls of the color by a predetermined value corresponding to the color.

19. The method of claim 16, wherein each table section has an inside edge adjacent to the plateau, an outside edge adjacent to the respective input aperture, a first side edge, and a second side edge; and wherein the inside edge is disposed higher than the outside edge and the first side edge and the second side edge are disposed higher than a medial portion of the table section.

* * * * *